US010652968B2

(12) United States Patent
Zheng

(10) Patent No.: US 10,652,968 B2
(45) Date of Patent: May 12, 2020

(54) LIGHT ADJUSTING DEVICE

(71) Applicant: Yueqing Hongji Trade Co., Ltd, Yueqing, Zhejiang (CN)

(72) Inventor: Shaotong Zheng, Zhejiang (CN)

(73) Assignee: YUEQING HONGJI TRADE CO., LTD, Yueqing, Zhejiang (CN)

( * ) Notice: Subject to any disclaimer, the term of this patent is extended or adjusted under 35 U.S.C. 154(b) by 0 days.

(21) Appl. No.: 15/444,702

(22) Filed: Feb. 28, 2017

(65) Prior Publication Data

US 2018/0063921 A1 Mar. 1, 2018

(30) Foreign Application Priority Data

Aug. 31, 2016 (CN) ..... 2016 1 0787978

(51) Int. Cl.

| | |
|---|---|
| ***H01H 23/12*** | (2006.01) |
| ***H05B 37/02*** | (2006.01) |
| ***H01H 23/24*** | (2006.01) |
| *H01C 10/10* | (2006.01) |
| *H01C 10/16* | (2006.01) |

(52) U.S. Cl.

CPC ..... *H05B 37/0209* (2013.01); *H01H 23/24* (2013.01); *H01C 10/10* (2013.01); *H01C 10/16* (2013.01)

(58) Field of Classification Search

CPC .... H05B 37/0209; H01C 10/10; H01C 10/16; H01H 23/12; H01H 15/10

USPC ..... 338/100; 200/294, 296, 339

See application file for complete search history.

(56) References Cited

U.S. PATENT DOCUMENTS

| | | | | |
|---|---|---|---|---|
| 6,005,308 | A * | 12/1999 | Bryde | H05B 39/00 200/335 |
| 8,835,783 | B2 * | 9/2014 | Kiyono | H01H 9/0271 200/293 |
| 8,853,893 | B2 * | 10/2014 | Savicki, Jr. | H05B 33/0815 200/339 |
| 2005/0247551 | A1 * | 11/2005 | Tsunoda | H01H 21/08 200/339 |
| 2009/0160354 | A1 * | 6/2009 | Burrell | H01H 23/30 315/291 |
| 2013/0106287 | A1 * | 5/2013 | Savicki, Jr. | H05B 33/0815 315/113 |

FOREIGN PATENT DOCUMENTS

| | | |
|---|---|---|
| CN | 200976695 Y | 11/2007 |
| CN | 201717166 U | 1/2011 |
| CN | 205018442 U | 2/2016 |

OTHER PUBLICATIONS

Chinese Office Action, Application No. 201810787978.8, dated Jun. 25, 2019, 4 pages.

* cited by examiner

*Primary Examiner* — Edwin A. Leon
*Assistant Examiner* — Iman Malakooti
(74) *Attorney, Agent, or Firm* — Ziegler IP Law Group, LLC.

(57) ABSTRACT

A light adjusting device includes a housing, a light adjusting assembly and a circuit switching mechanism. The circuit switching mechanism is connected to the light adjusting assembly. The light adjusting assembly can be in communication with a first circuit and a second circuit respectively by means of the circuit switching mechanism, so as to control light-emitting elements in the first and second circuits by one light adjusting device.

8 Claims, 3 Drawing Sheets

LIGHT ADJUSTING DEVICE

BACKGROUND

The aspects of the disclosed embodiments relate to the field of light-emitting element control devices, and in particular to a light adjusting device, such as a dimmer.

The development of lighting technology has produced a variety of lighting devices. The pursuit of the lighting devices is transited from the appearance of the lamps to the lighting control function of light adjusting equipment. A user can adjust the light intensity of the lighting equipment according to different environments, lighting conditions and personal preferences. The demands for lighting equipment are not only the ability to switch lights on and off, but also the ability to continuously adjust the intensity of the light produced by such equipment, and to be able to select or set an optimal lighting state.

One example of a light adjusting device is found in Chinese patent publication No. CN201717166U. In this light adjusting device, a rocker button is provided with a side plate on each of two longitudinal sides. The side plate is provided with a groove at the bottom end thereof. Two sides of the top end of the double-control movable contact are embedded in the grooves. At the bottom ends of the side plates on the rocker button, contacts are provided on two transverse sides at the bottom end of the double-control movable contact. A circuit board is provided with two wiring contacts corresponding to the contacts on the two sides at the bottom end of the double-control movable contact. The two wiring contacts are respectively for controlling the switch on/off of a power switch. A linkage member and the side plates oscillate at the same time by controlling the rocker button, so as to control the oscillation of the double-control movable contact, thereby forcibly switching on or off the power switch. However, this light adjusting device can only control the lighting equipment in a single circuit connected thereto. This is not conducive to multi-device centralized control.

Accordingly, it would be desirable to provide a light adjusting device that addresses at least some of the problems identified above.

SUMMARY

The aspects of the disclosed embodiments are directed providing a light adjusting device that can control more than one circuit.

In one embodiment, the light adjusting device comprises a housing, a light adjusting assembly and a circuit switching mechanism. The light adjusting assembly comprises a potentiometer and an operating structure which is connected to the potentiometer for adjusting the potentiometer. The circuit switching mechanism is connected to the light adjusting assembly and comprises a rocker, a spring and an ejector rod, an actuating member, a mounting seat, and a first side contact and a second side contact which are respectively connected to a first circuit and a second circuit.

The actuating member is of an arc-shaped structure having an opening facing the rocker, and is pivotably provided on the mounting seat. A first movable contact and a second movable contact are symmetrically provided on both sides of the actuating member with respect to a rotation axis of the actuating member. The first side contact and the second side contact are provided at the mounting seat corresponding to the first movable contact and the second movable contact.

The rocker is rotatably provided at the mounting seat, and one end of the spring is fixedly mounted below the rocker. The other end thereof is connected to one end of the ejector rod, and the other end of the ejector rod abuts against the bottom of the opening of the actuating member. A button for driving the rocker to rotate is provided on the housing, and the button drives the actuating member to rotate in a forward direction via the rocker, the spring and the ejector rod so as to communicate the first movable contact with the first side contact, or to rotate in a reverse direction so as to communicate the second movable contact with the second side contact.

Optionally, the light adjusting assembly comprises a first potentiometer and a second potentiometer connected in series, both of which are linear slide potentiometers. The operating structure is a first push rod and a second push rod respectively mounted to potentiometer handles of the first potentiometer and the second potentiometer.

Optionally, the first push rod and the second push rod are provided at side positions of the rocker, with sliding directions thereof being perpendicular to a rotation axis of the rocker.

Optionally, the housing comprises a top cover and a base which is detachably connected to the top cover; and a sliding groove is provided on the top cover, which allows the first push rod and the second push rod to extend out of the housing.

Optionally, the light adjusting device further comprises a thyristor and a heat dissipation plate made of aluminium, the heat dissipation plate being connected to the thyristor; and the top cover has an elastic fastener which is detachably connected to the heat dissipation plate, and the base is connected to the heat dissipation plate via threaded connection members.

Optionally, a circular hole for mounting the spring is provided below the rocker.

Optionally, the ejector rod is of a cylindrical structure, one end of which has a fitting portion which is fitted with the spring, and the other end of which is an abutment portion which abuts against the bottom of the opening of the actuating member, the abutment portion being of a smooth curved protrusion structure.

The technical solution of the disclosed embodiments has at least the following advantage:

According to the light adjusting device provided in the disclosed embodiments, the light adjusting assembly can be in communication with the first circuit and the second circuit respectively by means of the circuit switching mechanism, so as to control light-emitting elements in the first and second circuits by one light adjusting device. These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the following detailed portion of the present disclosure, the aspects of the disclosed embodiments will be explained in more detail with reference to the example embodiments shown in the drawings, in which.

BRIEF DESCRIPTION OF THE DISCLOSED EMBODIMENTS

As described herein, the exemplary embodiments overcome one or more of the above or other disadvantages known in the art.

The technical solution of the present invention will be clearly and completely described below in conjunction with the accompanying drawings, and obviously, the described embodiments are part of, not all of, the embodiments of the present invention. On the basis of the embodiment of the present invention, all other embodiments obtained by a person skilled in the art without any creative effort shall fall within the protection scope of the present invention.

Figure 1:
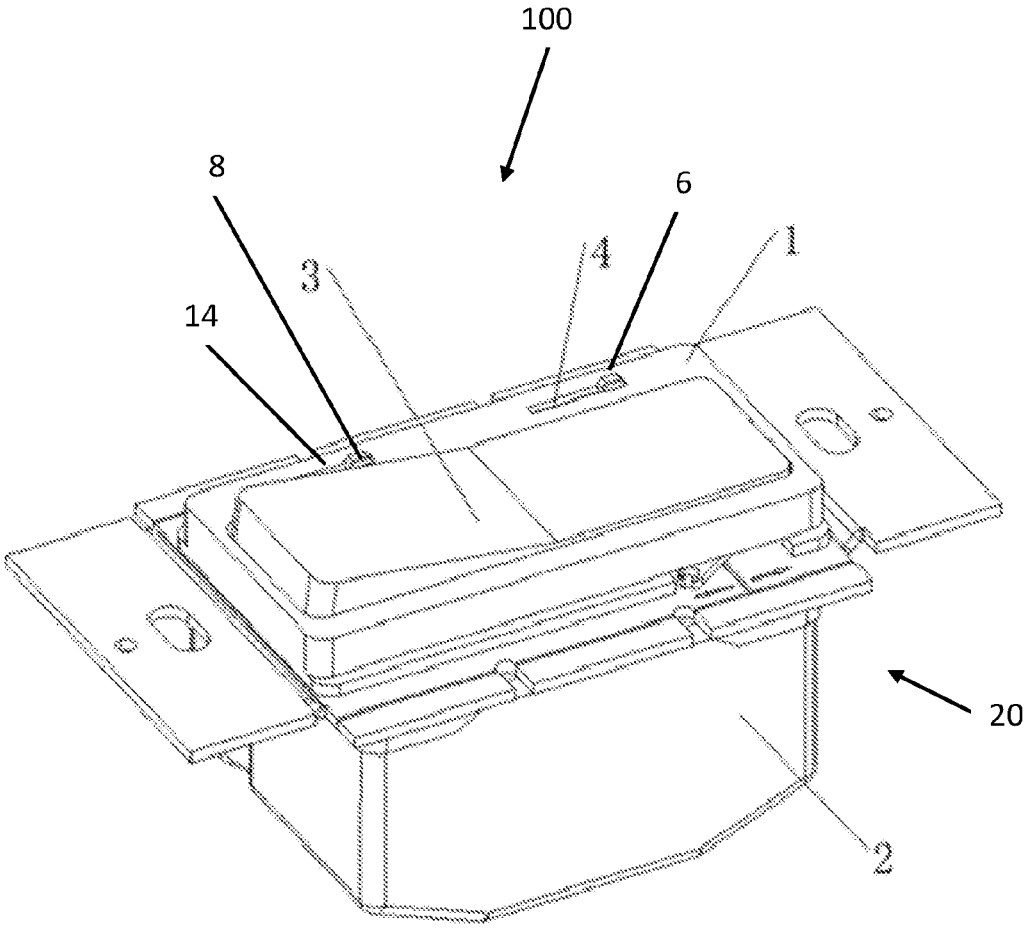
FIG. 1 is a perspective diagram of a light adjusting device according to aspects of the disclosed embodiments.
Figure 2:
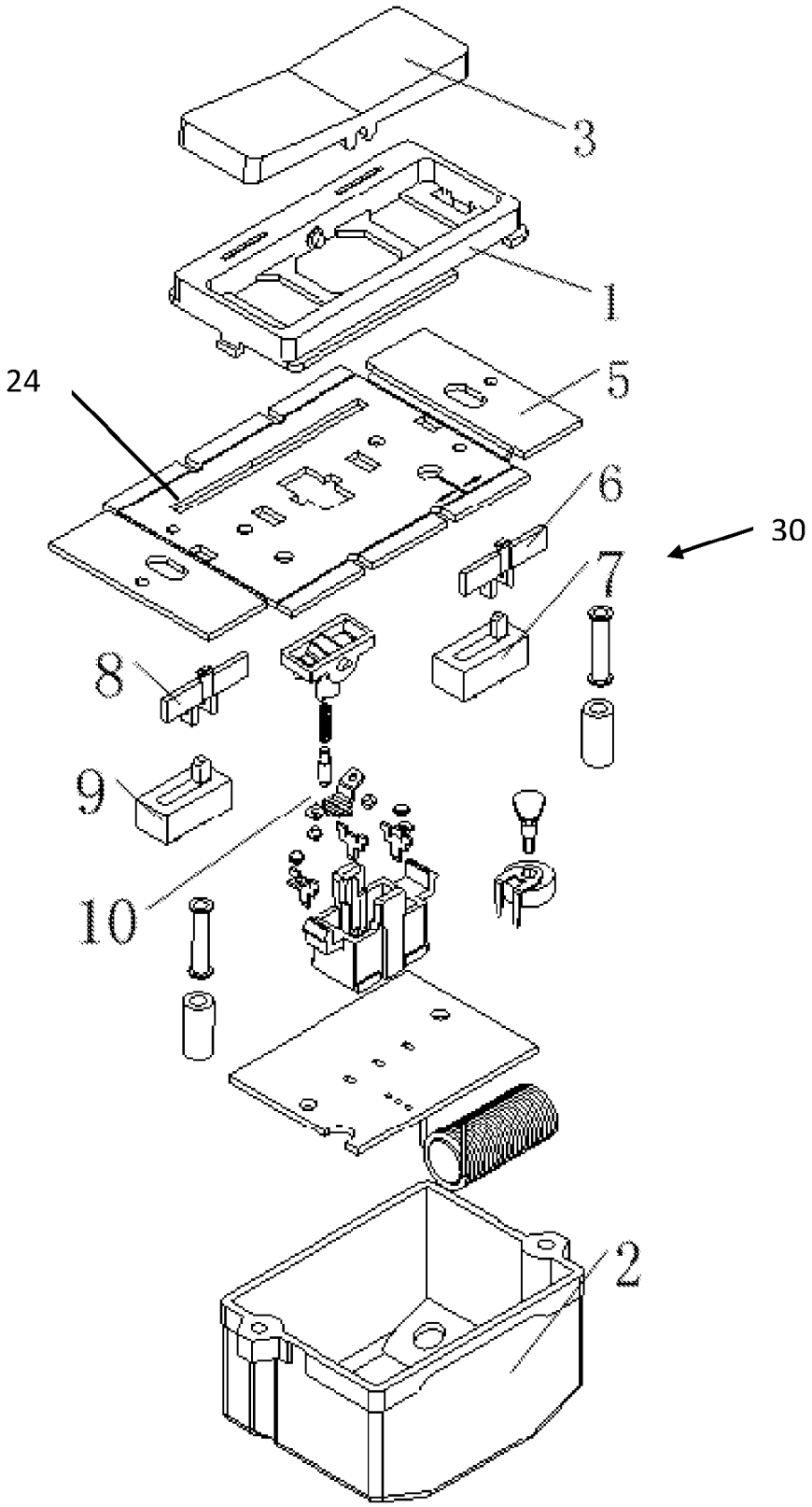
FIG. 2 is an assembly view of the light adjusting device according to aspects of the disclosed embodiment.
Figure 3:
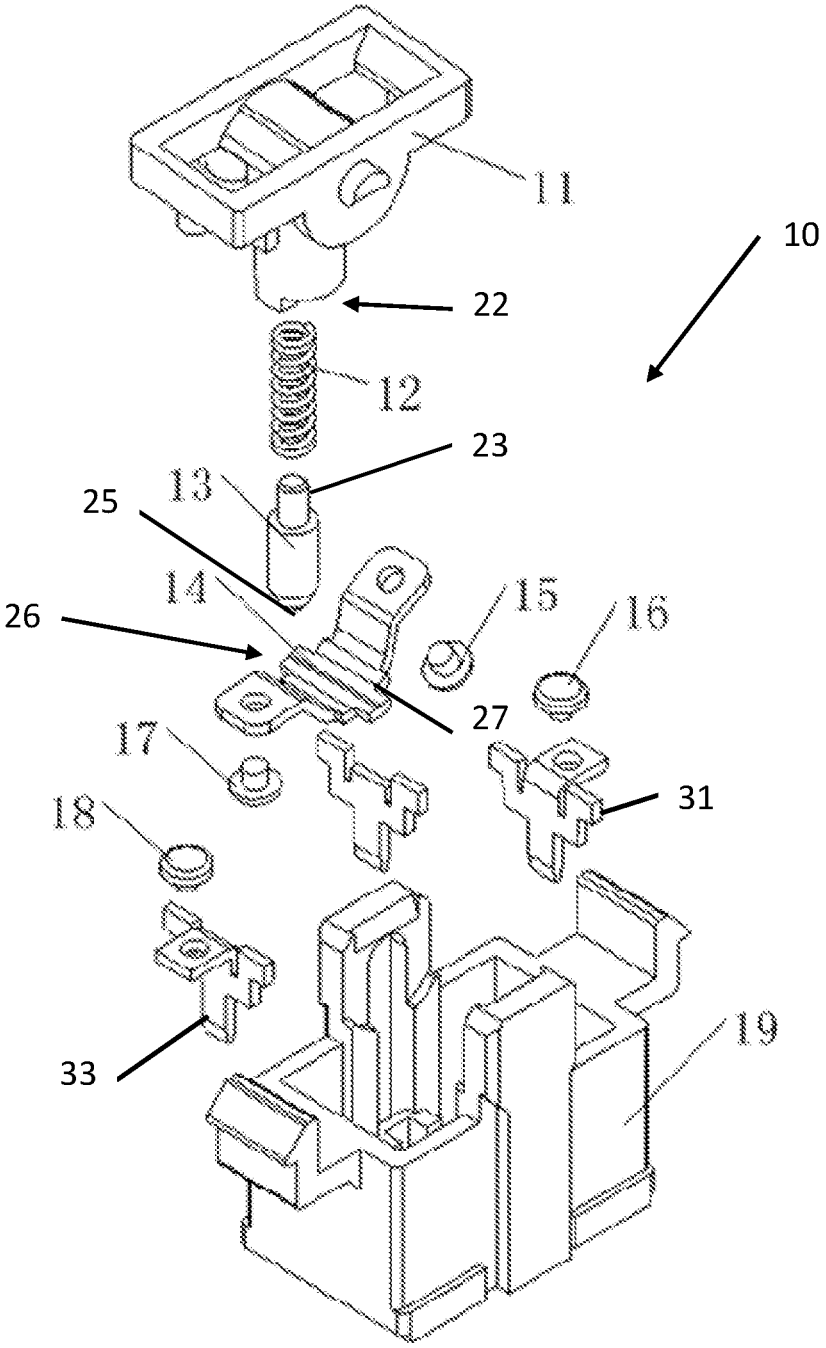
FIG. 3 is an assembly view of a circuit switching mechanism for a light adjusting device according to the aspects of the disclosed embodiments These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

Referring to FIGS. 1-3, the light adjusting device 100 of the disclosed embodiments comprises a housing 20, a light adjusting assembly 30 and a circuit switching mechanism 10. The aspects of the disclosed embodiments are configured to provide a light adjusting assembly 30 that is configured to control multiple lighting circuits. In one embodiment, the light adjusting device 100 comprises a dimmer or light dimming device.

In the embodiment shown in FIGS. 1 and 2, the housing 20 comprises a base 2 and a top cover 1. The top cover 1 is detachably provided on the base 2, meaning that it can be removed and replaced. The base 2 is generally in the form of a square box structure with an opening at the top thereof. The top cover 1 is configured to cover the opening so as to form an accommodation space together with the base 2. The housing 20 provides a protection function for the parts of the light adjusting device disposed within the accommodating space, and provides corresponding mounting structures.

Referring to FIG. 2, the light adjusting assembly 30, which in one embodiment comprises a dimming device, generally comprises a first potentiometer 7 and a second potentiometer 9. In the example of FIG. 2, the first potentiometer 7 and the second potentiometer 9 are connected in series with each other. In alternate embodiments, the first potentiometer 7 and the second potentiometer 9 can be electrically coupled in any suitable manner, other than including a series connection. In the embodiment of FIG. 2, the first potentiometer 7 and the second potentiometer 9 are both linear slide potentiometers.

The light adjusting assembly 30 further comprises a first push rod 6 and a second push rod 8 which are provided corresponding to the first potentiometer 7 and the second potentiometer 9, respectively. The first push rod 6 and the second push rod 8 are provided on, or connected to, control handles of the first potentiometer 7 and the second potentiometer 9, respectively. The first push rod 6 and the second push rod 8 extend out of the housing 10 by means of a sliding groove 4, shown in FIG. 1, which is provided on the top cover 1. The heat dissipation plate 5 includes a groove 24 to accommodate the first push rod 6 and the second push rod 8.

The first push rod 6 and the second push rod 8 are the operating structure for operating the potentiometers 7, 9. The first push rod 6 and the second push rod 8 are provided at side positions of the rocker 11. The resistance(s) of the first potentiometer 7 and/or the second potentiometer 9 are changed by sliding the first push rod 6 and/or the second push rod 8, that is to say, the resistance of the circuit is changed so as to achieve the light adjusting function. As an alternative embodiment, the light adjusting assembly 20 may be provided with only one push rod, which is fitted with both the first potentiometer 7 and the second potentiometer 9.

It should be apparent that the linear slide potentiometers 7, 9 may be replaced by a rotary potentiometer, and accordingly, the operating structure is a rotary member fitted with a rotary handle of the rotary potentiometer.

The light adjusting assembly 20 in this technical solution is provided with two potentiometers 7, 9, so that the light adjusting range of the light adjusting assembly can be increased and the adaptability is wider.

Referring to FIGS. 2 and 3, the circuit switching mechanism 10 comprises a rocker 11, a spring 12, an ejector rod or knock-out pin 13, an actuating member or function key 14, and a mounting seat 19. As shown in FIG. 1, a button 3 is provided on the top cover 1. The button 3 is rotatably provided on the top cover 1. The rocker 11 is fitted with the button 3, and is rotatably provided in the mounting seat 19. A circular hole 22 is provided below the rocker 11, the spring 12 is provided in the circular hole 22, and the ejector rod 13 is provided at the lower end of the spring 12.

The ejector rod 13 is of a cylindrical structure, one end of which has a fitting portion 23 which is fitted with the spring 12, and the other end of which has an abutment portion 25 which abuts against the actuating member 14, the abutment portion 25 having a smooth curved protrusion structure.

The actuating member 14 is of an arc-shaped structure having an opening 26 facing the rocker 11, and is rotatably mounted to the mounting seat 19. The abutment portion 25 of the ejector rod 13 abuts against the bottom end 27 of the opening 26 of the actuating member 14.

A first movable contact 15 and a second movable contact 17 are symmetrically provided on the actuating member 14 with respect to a rotation axis of the actuating member 14. The first side terminal 31 and the second side terminal 33 are provided on the mounting base 19 corresponding to the first movable contact 15 and the second movable contact 17, respectively. A first side contact 16 is disposed in the first side terminal 31 and is configured to make electrical contact with the first movable contact 15. A second side contact 18 is disposed in the second side terminal 33 and is configured to make electrical contact with the second movable contact 17. A first electrical circuit and a second electrical circuit (not shown) including light-emitting elements, such as one or more light bulbs, are connected to the first side contact 16 and the second side contact 18, respectively.

The button 3 drives the rocker 11 to rotate about its axis, and drives the actuating member 14 to rotate about its own rotation axis via the spring 12 and the ejector rod 13. The actuating member 14 rotates in a forward direction to communicate the first movable contact 15 with the first side contact 16, so that the light adjusting assembly 30 is connected to the first circuit. The light adjusting assembly 30 can adjust the luminance of the light-emitting element in the first circuit.

The actuating member 14 rotates in a reverse direction to communicate the second movable contact 17 with the second side contact 18, so that the light adjusting assembly is connected to the second circuit. The light adjusting assembly 30 can adjust the luminance of the light-emitting element in the second circuit.

It can be seen from the above description that the light adjusting assembly 30 can be in communication with the first circuit and the second circuit respectively by means of the circuit switching mechanism 10, so as to control light-emitting elements in the first and second circuits by one light adjusting device.

In this embodiment, the extending direction of the sliding groove 4 and 14 is perpendicular to the rotation axis of the rocker 11.

As a preferred embodiment, a surface of the first movable contact 15 and the second movable contact 17 is provided with a silver layer.

The circuit switching mechanism 10 is further provided with a thyristor. The light adjusting device 100 further comprises a heat dissipation plate 5 which is made of aluminum due to a large amount of heat generated during the operation of the thyristor. The heat dissipation plate 5 is connected to the thyristor. The top cover 1 has an elastic fastener or clasp which is detachably connected to the heat dissipation plate 5, and the base 2 is connected to the heat dissipation plate 5 via threaded connection members or fasteners.

Obviously, the embodiments as described above are merely made for clarity of illustration and do not limit the implementation manner. For a person skilled in the art, other changes or variations may be also made on the basis of the foregoing description. It is unnecessary and also impossible to exhaustively describe all possible embodiments herein. Obvious changes or variations derived therefrom are still within the protection scope of the present invention. Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A light adjusting device, comprising a housing, a light adjusting assembly and a circuit switching mechanism, wherein the light adjusting assembly comprises:

a first potentiometer connected to a first electrical circuit to control a light adjusting function of the first electrical circuit, a second potentiometer connected to a second electrical circuit to control a light adjusting function of the second electrical circuit and an operating structure which is connected to the first potentiometer and the second potentiometer for adjusting the light adjusting function of the first potentiometer and light adjusting function of the second potentiometer; wherein the first potentiometer and the second potentiometer comprise linear slide potentiometers that are electrically connected in series and the operating structure comprises a first push rod mounted to handle of the first potentiometer and a second push rod mounted to a handle of the second potentiometer;

the circuit switching mechanism is configured to connect the light adjusting assembly to one of the first electrical circuit or the second electrical circuit, the circuit switching mechanism comprising a rocker, a spring, an ejector rod, an actuating member, a mounting seat, and a first side contact (16) and a second side contact (18) which are respectively connected to the first electrical circuit and the second electrical circuit;

the actuating member is an arc-shaped structure having an opening facing the rocker, and is pivotably provided on the mounting seat;

a first movable contact and a second movable contact are symmetrically provided on both sides of the actuating member with respect to a rotation axis of the actuating member;

the first side contact and the second side contact are provided at the mounting seat, corresponding to the first movable contact and the second movable contact, the first side contact configured to make electrical contact with the first movable contact and the second side contact configured to make electrical contact with the second movable contact, the first electrical circuit electrically connected to the first side contact and the second electrical circuit electrically connected to the second electrical circuit;

the rocker is rotatably provided at the mounting seat, and one end of the spring is fixedly mounted below the rocker and the other end thereof is connected to one end of the ejector rod, and the other end of the ejector rod abuts against the bottom of the opening of the actuating member; and a button configured to driving the rocker to rotate is provided on the housing, and the button configured to drive the actuating member to rotate in a forward direction via the rocker, the spring and the ejector rod configured to communicate the first movable contact with the first side contact to connect the light adjusting assembly to the first electrical circuit, the button configured to drive the actuating member to rotate in a reverse direction to communicate the second movable contact with the second side contact to connect the light adjusting assembly to the second electrical circuit.

2. The light adjusting device according to claim 1, wherein the first push rod and the second push rod are provided at a first side of the rocker, with a sliding direction of the first push rod and the second push rod is perpendicular to a rotation axis of the rocker.

3. The light adjusting device according to claim 2, wherein the housing comprises a top cover and a base which is detachably connected to the top cover; and a sliding groove is provided on the top cover configured to allow the first push rod and the second push rod to extend out of the housing.

4. The light adjusting device according to claim 3, wherein the light adjusting device further comprises a thyristor and a heat dissipation plate made of aluminium, the heat dissipation plate being connected to the thyristor; and the top cover has an elastic fastener which is detachably connected to the heat dissipation plate, and the base is connected to the heat dissipation plate via threaded connection members.

5. The light adjusting device according to claim 1, wherein a circular hole for mounting the spring is provided below the rocker.

6. The light adjusting device according to claim 1, wherein the ejector rod is of a cylindrical structure, one end of which has a fitting portion which is fitted with the spring, and the other end of which is an abutment portion which abuts against the bottom of the opening of the actuating member, the abutment portion being of a smooth curved protrusion structure.

7. The light adjusting device according to claim 1 wherein the first electrical circuit comprises a first light-emitting element and the second electrical circuit comprises a second light emitting element, wherein the first potentiometer controls the light adjusting function of the first light emitting element and the second potentiometer controls the light adjusting function of the second light emitting element.

8. The light adjusting device according to claim 1, wherein the the first push rod and the second push rod are connected together to form a single push rod connected to a handle of the first potentiometer and a handle of the second potentiometer.

* * * * *